United States Patent [19]

Buckman et al.

[11] Patent Number: 5,006,046

[45] Date of Patent: Apr. 9, 1991

[54] METHOD AND APPARATUS FOR PUMPING LIQUID FROM A WELL USING WELLBORE PRESSURIZED GAS

[76] Inventors: William G. Buckman, 504 Memphis Junction Rd.; Henry B. Steen, III, 109 Creekwood Ave.; William G. Buckman, Jr., 208 Whispering Hills, all of Bowling Green, Ky. 42101

[21] Appl. No.: 410,841

[22] Filed: Sep. 22, 1989

[51] Int. Cl.[5] ..... F04F 1/06

[52] U.S. Cl. ..... 417/54; 417/132; 417/138; 417/145; 166/372

[58] Field of Search ..... 417/109, 110, 113, 118, 417/130, 132, 137, 138, 139, 142, 143, 145, 54, 65; 166/372

[56] References Cited

U.S. PATENT DOCUMENTS

| | | | |
|---|---|---|---|
| 1,853,269 | 4/1932 | Harris | 417/143 |
| 2,565,616 | 8/1951 | Mennesson | 417/142 |
| 3,894,814 | 7/1975 | Morgan | 417/138 |
| 3,991,825 | 11/1976 | Morgan | 417/138 |
| 4,021,147 | 5/1977 | Brekke | 417/138 |
| 4,181,470 | 1/1980 | Gillett | 417/138 |
| 4,427,345 | 1/1984 | Blann et al. | 417/143 |
| 4,527,633 | 7/1985 | McLaughlin et al. | 166/372 |
| 4,726,420 | 2/1988 | Weeks | 166/372 |

*Primary Examiner*—Leonard E. Smith
*Assistant Examiner*—M. Kocharov

[57] ABSTRACT

There is provided a method and apparatus for removing liquid from a well using well bore pressurized gas. A U-shaped tube having a small orifice near the bottom thereof is received in the well. The upper portions of both legs of the tube are connected to well bore pressurized gas. A liquid sensor is received in one leg of the tube. When liquid flowing into the tube through the orifice rises to the level of the sensor, a valve, which is connected to one leg of the tube, is opened and the well head pressurized gas forces the liquid out of the tube and then out of the well.

25 Claims, 2 Drawing Sheets

METHOD AND APPARATUS FOR PUMPING LIQUID FROM A WELL USING WELLBORE PRESSURIZED GAS

BACKGROUND OF THE INVENTION

1. Field of the Invention

The present invention relates to the field of well fluid removal. More particularly, it relates to the removal of well fluid using pressurized gas available in the well bore.

2. Description of Prior Art

The accumulation of liquids in oil and natural gas well casings restrict the flow of fluids from the producing formation to the bore hole by exerting pressure on the face of the producing formation. Several methods of removal have been devised for removal of liquids from a bore hole, each having their own particular advantages and disadvantages. One method is by dipping the liquid out of the casing with a long bucket or "swab" operated by a cable from a truck-mounted winch.

During the initial production of an oil well often the gas pressure in the reservoir is sufficient for the oil well to flow naturally. In the production life of a flowing oil well, a point will be reached wherein there is insufficient gas pressure to overcome the hydrostatic head created by fluid accumulation in the well bore principally because of the decrease in reservoir gas pressure. Another contributing factor to the well's ability to flow is the accumulation of formation water in the well bore which will produce a fluid hydrostatic head equal to the pressure of the gas which enters the reservoir. To maximize the returns from an oil/gas well, it is important to conserve the gas in the reservoir because the gas content is the primary motive source pushing the oil to the well bore. As a well becomes watered out or the formation gas is depleted to the extent that production is seriously reduced or terminated, it is necessary to periodically swab the well or install mechanical gear to pump liquid from the bore hole to reduce the hydrostatic head. Either operation decreases the economic efficiency of the oil or gas well, requires additional supervision and the utilization of expensive equipment.

Another gas lift system consists of placing a tubing down the center of the bore hole, then one can pump the well by intermittently injecting gas from an external source either into the bore hole or the well casing to propel the oil either up the well casing or the tubing.

Another method is to place small holes in the tubing at appropriate intervals and the oil will flow from the bore hole into the tubing. The gas delivered through the tubing will bubble the oil to the top and out of the bore hole. This method is not very efficient and it requires a large ratio of the gas volume used to the volume of liquid lifted.

A device patented by Hart discussed in U.S. Pat. No. 3,408,949 is a downhole float tube encircling the lower end of production tubing which moves vertically to intermittently produce fluid from the well. This device is designed to pump slugs of liquid at a time. While his device is to operate automatically downhole, it is obvious that sand and grit reduces the reliability of this device. Inertia of operation of the float tube will tend to waste gas with each cycle. Sand and the dirty well bore will obviously be very detrimental to the operation of this mechanical apparatus. Last but not least, a malfunction may require one to pull all of the tubing and the apparatus from the bore hole to correct the malfunction.

The autoswab invented by Gramling and discussed in U.S. Pat. No. 4,070,134 utilizes natural gas pressure to operate a free-floating pressure-sensitive swab to automatically remove fluids from well casings. The bore hole environment with sand and paraffin presents difficulties for these mechanical devices.

Jack pumps are the most used devices to lift oil and water from oil and gas wells. Unfortunately, this method is capital intensive and requires considerable maintenance. It also requires heavy equipment to pull and insert the tubing, rods and to move the jacks.

OBJECTS OF THE INVENTION

The primary object of the present invention is to provide a low cost and efficient method of removing liquids from natural gas or oil wells even in remote areas without the need for public utility electrical power.

SUMMARY OF THE INVENTION

In accordance with one form of this invention, there is provided an apparatus and method for removing liquid from a well using well bore pressurized gas as the motive source. A tubing is received in the well. The tubing has a gas inlet portion and a liquid discharge portion. The tubing has an opening therein for receiving liquid from the well. The gas inlet portion of the tubing is connected to the well for receiving pressurized gas. A valve is connected to the liquid discharge portions of the tubing. A mechanism is provided for opening and closing the valve. When the valve is closed, liquid will accumulate in the tubing through the opening, and when the valve is open gas will force the liquid through the liquid discharge portion of the tubing and out of the well.

This invention has no working parts down the bore hole. Since it operates by pushing a column of liquid or a slug up the tubing and out of the well, it is much more efficient than the other traditional methods which bubble gas through the oil or water to remove the liquid. The apparatus is economical in cost and requires minimum effort for installation, maintenance, and supervision. These factors make this invention a candidate for many stripper wells.

The preferred method and apparatus is set forth below. A tubing string, preferably a U-tube, is received in the well. The top of one side of the U-tube is connected to the top of the enclosed bore hole and the top of the other side of the U-tube is connected to a low pressure liquid storage tank through a normally closed valve. A non-mechanical sensor extends down one leg of the U-tube and is connected to a solid state controller which may be powered by a battery. As the liquid rises in the bore hole, it will enter the U-tube through the opening or orifice located near the bottom of the U-tube until it reaches the sensor located at the appropriate height in the U-tube. When the sensor detects the liquid, the solid state controller opens the valve and the reduction to atmospheric pressure of one leg and the well bore gas pressure on the other leg of the U-tube causes the column of liquid to be pumped toward the low pressure (atmospheric) side and up out of the well and into the storage tank. Either by detecting the liquid column using a sensor at the liquid column exit side of the U-tube or by using a timing device, a valve connecting this leg to atmospheric pressure at the top of the well head is then closed. Preferably another valve is connected between the discharge leg and the well and is normally open to enable that liquid discharge line of the U-tube to be pressurized at the well bore pressure This valve is closed during pumping.

The system may have a sensor down one leg of the U-tube for initiating the pumping cycle or only one sensor at the exit of the bore hole connected to a controller. In the latter case, the controller measures the pumping cycle time for the liquid to be pumped to the top of the well bore (or sensor). The controller compares this time to the optimum time for the given conditions and modifies the interval of time to the next cycle.

Quite frequently the face of gas and oil formations need to be chemically treated to remove paraffin and other residues. One may simply operate this system in a manual mode to lower the liquid in the bore hole such that the bore hole liquid is at or below the formation and chemicals can be exerted down the tubing or bore hole to enable one to treat the well. A manually operated valve may be placed at the top of the gas line tube between the U-tube and the bore hole to enable one to treat the well chemically. The manual valve can be closed and the chemical treatment inserted down the gas down side line to flow into the well and treat the oil and gas formation.

For shallow wells with depths less than 800 feet, one man can carry the necessary supplies to outfit a well and install the plastic tubing and controls necessary to operate the well.

BRIEF DESCRIPTION OF THE DRAWINGS

Referring to the drawings.

DETAILED DESCRIPTION OF THE PREFERRED EMBODIMENTS

Figure 1:
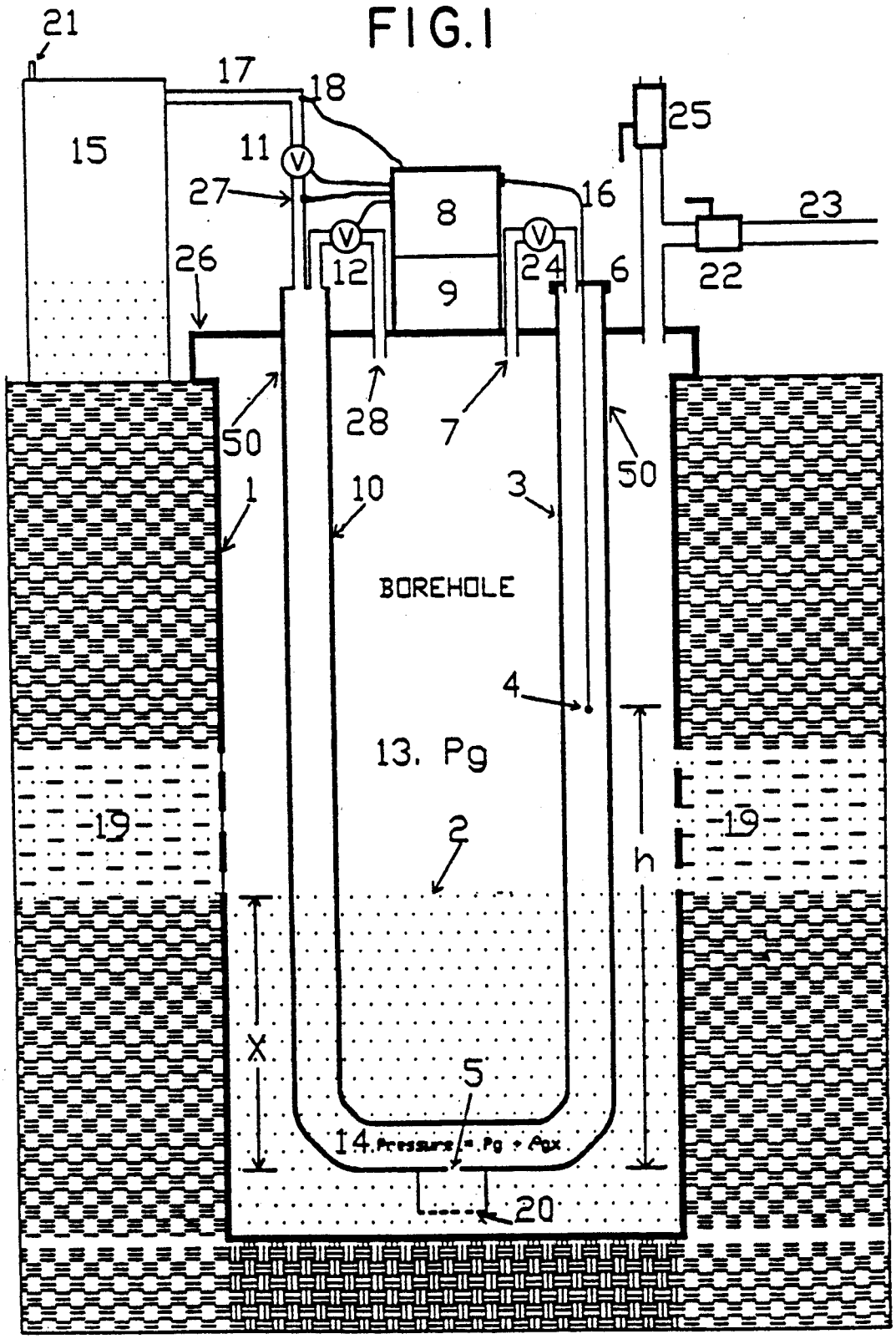
FIG. 1 is a general schematic sectional view of the preferred embodiment of a bore hole gas lift system of this invention.

FIG. 1 shows the elements of the pumping system associated with a bore hole. The bore hole 1 extends from the top of the ground to the bottom of the well bore and the oil and gas formation is denoted by 19. A well casing cap 26 covers and seals the top of the well casing. A one-way gas valve 22 is connected between the bore hole gas and the gas transmission line 23 for capturing the gas from the well. The liquid level in the bore hole is designated by 2 and is at a height of X above the bottom of the U-tube 50. The right side 3 of the U-tube, which is the gas down line, permits liquid to rise to the sensor 4, which is located in gas down line 3, and it serves for the gas to go down during propulsion of liquid. Sensor 4, which is preferably a non-mechanical sensor such as a thermistor and is electrically connected to controller 8, detects liquid at the level h above the bottom of the U-tube and this height can be adjusted by passing the lead 16 to the sensor through a compression fitting 6 at the top of the bore hole. A small orifice 5, which can be covered by screen 20, is located near the bottom of the U-tube although it may also be located a small distance up the gas down line 3 or the liquid discharge line 10. The compression fitting 6 enables an electrical lead 16 to extend from the controller 8 to the sensor in the appropriate level in the gas down line. Item 7 denotes the normally open passage from the top of the enclosed well bore 1 to the gas down line 3 of the U-tube. A manual valve 24 at passage 7 is normally open during normal operation and is closed only to treat the well or for other processes. For example, by closing valves 24, 12, 22, and 11 and opening valve 25, the differential pressure will reverse the flow of fluid through the orifice 5 to clean out the orifice. The solid state controller 8 obtains a signal from the liquid level sensor 4 and controls valve 11 and valve 12. Valve 11 is connected to liquid discharge line 10, which is on the left side of the U-tube, determines whether the liquid discharge line 10 is directly connected to a low gas pressure line 17 leading to a liquid holding tank 15 or a liquid/gas separator. Tank 15 has a vent in the top to maintain the pressure in the tank near atmospheric pressure. Valve 12, which is connected between the liquid drainage line 10 and bore hole 1, determines whether the liquid discharge line 10 of the U-tube is connected to the bore hole gas. The battery 9 serves as a source of electricity for the controller 8. As previously stated, the left side 10 of the U-tube serves as the liquid discharge tube and receives gas pressure near the top of the well bore which exits in space 13 when valve 12 is open. The total pressure near the small orifice 5, indicated by 14 is $Pg+Dgx$, where D is the density of the liquid, g is the acceleration due to gravity, and x is the height of the liquid above the orifice and Pg is the well bore gas pressure. Item 15 is the holding tank for oil and/or water. The slug sensor 18, which can be a reed switch or a thermistor or other detectors, received in line 17 and electrically connected to controller 8, detects when the column of liquid reaches the top of the bore hole and enables the controller 8 to close valve 11 and open valve 12 at the appropriate time to conserve the gas used in each pump cycle. A pressure sensor 27 is exposed to the bore hole gas pressure during the resting cycle and this sensor 27 is connected to the controller 8 to optimize the pumping efficiency. A screen 20 is placed over the bottom of the orifices to filter the fluids going to the orifice.

Another embodiment of the pumping system consists of all elements in the system listed above with the use of a controller 8 and the omission of sensor 4 located in the tube in the well bore.

OPERATION

Consider that the well bore has been cleaned out or swabbed of most oil and water and the elements described above are placed in or about the bore hole. Initially valve 11 is closed and valve 12 is open. As time elapses, the well bore gas pressure Pg increases as does the height of the liquid level 2 inside the well bore. When the liquid level rises in the well bore above the small orifice 5 located near the bottom of the U-tube, liquid will slowly flow through the orifice and go up each side of the U-tube. The liquid level will be about the same level in the U-tube and the bore hole unless the liquid is very rapidly rising in the bore hole. The difference in level, if any, will primarily depend upon the resistance of liquid flow through the small orifice 5.

When the liquid in the U-tube rises and covers sensor 4, a signal will be sent to the controller 8 and it will cause valve 12 to close and subsequently open valve 11. These valves may either be operated directly by electrical solenoids or by the controller controlling pilot openings to enable the bore hole gas pressure to operate the valves. With valve 12 being closed, high gas well bore pressure is removed from liquid discharge line 10. Since valve 11 has just been energized open, the liquid discharge tube is now connected to the low pressure outside of bore hole line 17 leading to a holding tank 15 vented to a low pressure. However, high well bore gas pressure remains on gas down line 3. As gas flows up liquid discharge tube 10 to the low gas pressure, the liquid will rise in the liquid discharge tube of this U-tube 10 and the liquid on right side of the U-tube or gas down line 3, will be lowered. While the liquid is flowing from the bottom of the gas down line 3 of the U-tube to the liquid discharge tube of the U-tube, some liquid will tend to flow up through the small orifice 5 because the pressure at the bottom of the orifice is a little greater than on the inside of the tube side of the orifice. Since the small orifice 5 offers considerable resistance for fast flow due to the liquid flow through it, negligible liquid will flow out of the U-tube through the orifice 5 and into the well bore as the column of liquid is transferred from the gas down line 3 to the liquid discharge line 10 and up and out of the well bore.

Assuming lines 3 and 10 have the same diameter and the difference in bore hole gas pressure Pg and the atmospheric pressure is greater than 2 Dgh, where D is the density of the liquid, the liquid will tend to be raised as a short column of length 2h up the liquid discharge tube. When this liquid column, or slug, is ejected from the liquid discharge line, sensor 18 signals the controller to close valve 11 and to open valve 12. The system is now ready for another cycle when the liquid again covers the sensor 4 in the gas down line 3. The cycle is repeated each time this occurs. The volume pumped during each cycle is primarily determined by the height of the sensor in the gas line tube.

Using the system above with the omission of the sensor 4 down the gas down line 3, a controller 8 may be used to optimize the pumping efficiency. The controller 8 measures the time required from the start of the pumping cycle until the liquid column rises to the top of the liquid discharge tube 10 and is detected by liquid sensor 8. The liquid sensor 18 signal will cause the controller 8 to terminate the pumping cycle, that is, close valve 11 and open valve 12, and it will stop its internal timing circuit that indicates the time of the pumping cycle from the initiation of that pumping cycle until the time that the liquid column interacts with the liquid sensor 18. The controller subsequently stores the time required for the immediate previous pumping cycle. During the resting cycle, with valve 11 closed and valve 12 open, liquid flows from the bore hole 1 through the orifice 5 and up the gas down side tube 3 and the liquid discharge tube 10. The controller 8 compares the length of the last pumping cycle time interval to known measured time intervals required to pump the desired length of liquid column from a particular depth in the well bore. If the time interval from initiation of the previous pumping cycle to when the column reached liquid sensor 18 is short compared with previous measurements and given conditions, this indicates that a shorter than desired column of liquid was pumped during the last cycle. The controller then lengthens the resting time cycle to allow more oil and/or water to flow from the bore hole through the orifice 5 and up tubes 3 and 10. During the next pump cycle, the liquid column length will be longer than in the recent past pump cycle. Vice versa, if the previous pumping cycle time was too long, this indicates that the column of liquid being pumped was too long; therefore, the controller shortens the resting time to the next initiation of pumping. The controller continues this controlling process through all subsequent pumping cycles to optimize the overall pumping efficiency of the system. This system and method of pumping eliminates the need to sense the liquid in either the bore hole 1, the liquid discharge tube 10 or the gas down line 3. To further optimize the pumping efficiency, a pressure sensor 27 monitoring the bore hole gas pressure is connected to the controller 8. In the event of the bore hole gas pressure changes, the controller will automatically adjust the resting time interval to enable the appropriate quantity of liquid to flow through the orifice so that the next column length of liquid pumped leads to optimum pumping efficiency.

Efficiency of lift is a very important consideration and is often expressed as the ratio of the standard cubic feet of gas used to the volume of liquid lifted. While lifting 7.92 gallons of oil from a depth of 860 feet, the pressure in a 160 gallon storage tank dropped from 150 psig to 105 psig. Assuming isothermal conditions, this results in an unexpectedly low gas to liquid ratio of 347 standard cubic feet of gas per barrel of oil and for assumed adiabatic conditions only 130 standard cubic feet of gas per barrel.

Figure 2:
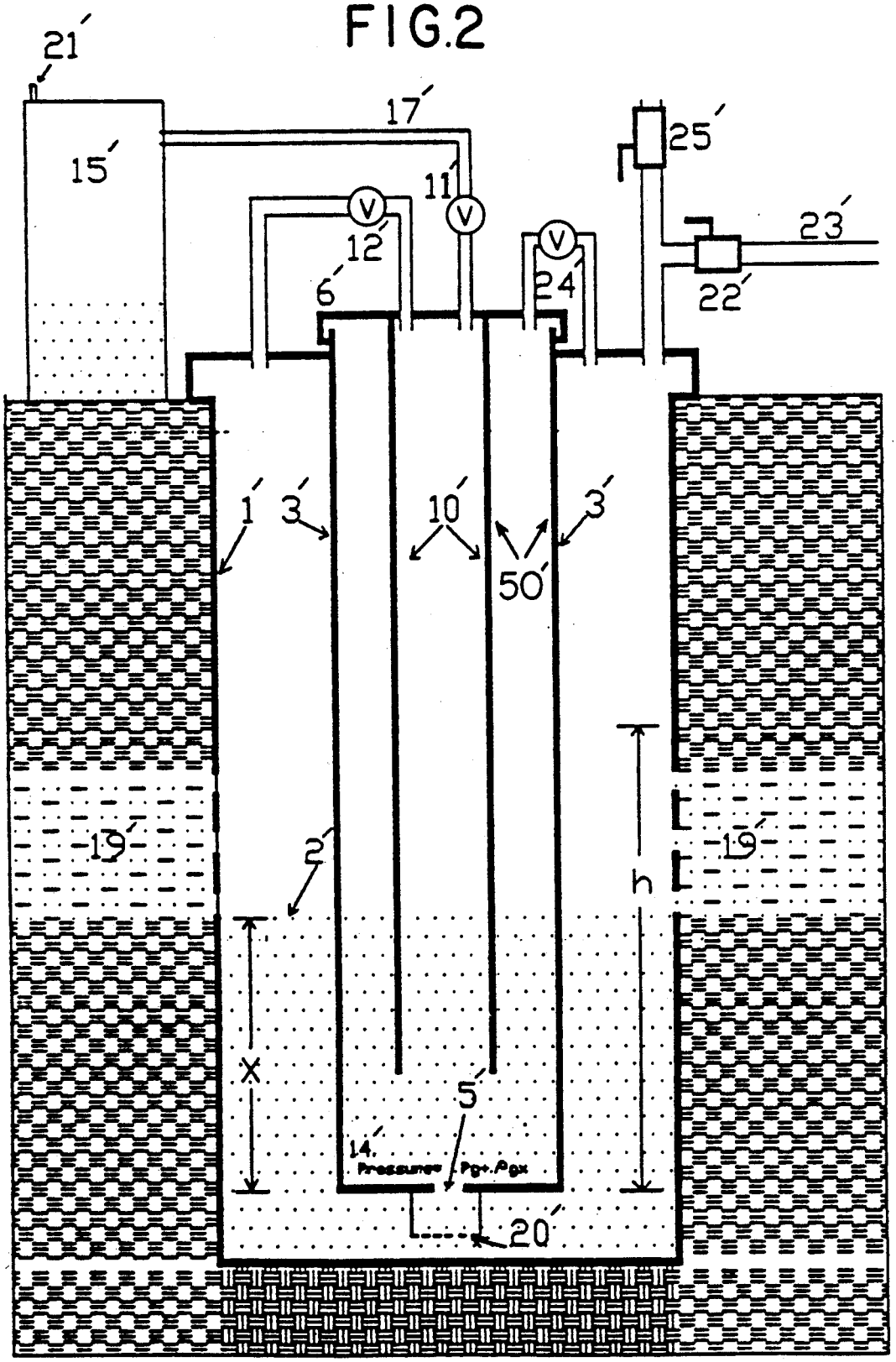
FIG. 2 is a general schematic sectional view of an alter native embodiment of a bore hole gas lift of this invention. This embodiment enables easier installation and retrieval from the bore hole.

Many variations of the above system may be used without departing from the spirit of this invention. One such variation is shown in FIG. 2. Referring now more particularly to FIG. 2, there is shown a device for pumping well bore liquid using well bore gas which is substantially identical to that shown in FIG. 1 except that concentric tubes 50' are used instead of U-tube 50. Outer tube 3' operates as the gas down line in lieu of the right side of the U-tube shown in FIG. 1 and will house a sensor located at height h. For simplicity's sake, sensors, controller, battery, and associated lines connecting the valves 11' and 12' are not shown since they are shown in FIG. 1. Inner tube 10' acts as the liquid discharge line in lieu of the left side of U-tube 10 shown in FIG. 1.

Referring again to FIG. 1, the orifice 5 should be a small fraction of one inch in diameter for the system to function best and it can be positioned at any place near the bottom of the U-tube. Variable orifice sizes operating with a ball valve may be used such that the opening depends upon the velocity of liquid flowing through the orifice. The orifice size desired is determined by the gas well bore pressure, amount and kind of liquid produced, and the sizes of the parts of the U-tube. Furthermore, the system may be set to free run at a particular time interval without using a sensor feedback. Sensors other than thermistors, such as acoustic wave sensors, may also be used to sense the appropriate time to initiate the pumping cycle.

EXAMPLE

Consider the particular example where the density of the oil is 0.9 of water, the total U-tube pipe has a diameter of one inch, and the sensor 4 is located 100 feet above the orifice, the distance from the top of the well to the sensor 4 is 800 feet, the orifice has a diameter of 5/64", the bore hole gas pressure is 150 psig, and the diameter of the bore hole is six inches. When the liquid touches the sensor, the volume of bore hole gas at 150 psig is about $(\pi)\ (\frac{1}{4}\ \text{ft})^2 800\ \text{ft} = 157\ \text{ft}^3$. The volume of liquid in the U-tube is $(\pi)\ (1/24\ \text{ft})^2 (200\ \text{ft}) = 1.09\ \text{ft}^3 (8.15\ \text{gal})$. As the bore hole gas expands to push the bottom of the volume to the top of the liquid discharge line the liquid at the sensor has traveled about 800 ft + 100 + 100 ft = 1000 ft and the gas has expanded a total volume of $(\pi)(1/24\ ft)^2 1000\ ft = 5.45\ ft^3$. Assuming no change in temperature of the gas, then PiVi=PfVf where i denotes the initial conditions for the gas and f denotes the final condition as the column leaves the bore hole. Pf=PiVi/Vf=(150 psig)×(157 $ft^3$)/162.45 $ft^3$ or Pf=145 lbs/$in^2$. Total gas used in one stroke is then equal to Pav(Volume U-tube)=(147 lbs/$in^2$+14.7)×(5.45 $ft^3$/14.7)=60 standard cubic feet (scf) and the volume of liquid lifted=1.09 $ft^3$×7.92 gal/$ft^3$/ 42 gal/bbl=0.21 barrels of oil. The ratio is then 60 scf of gas to 0.21 barrels of oil or a small 286 scf/bbl. Experimental measurements indicates it will take about 90 seconds for this column to get to the top of the bore hole after initiating the cycle. For 30 weight oil, it was observed that a differential pressure of 25 lbs/$in^2$ causes about one pint of oil to flow through a 5/64" orifice in 20 seconds. Since after the column passes the orifice the differential pressure across the orifice is given approximately by the relation Dgh, then the differential pressure across the orifice is about 27 psi and one expects about (1 pint/20 sec)×(90 sec)=4.5 pints or about one-half gallon to flow through the orifice during this part of the cycle. Theoretically, one should be able to pump over 400 barrels per day if the well is a high producer and plenty of gas is available.

It should be understood that the foregoing relates to only preferred embodiments of the invention and that it is intended to cover all changes and modifications which do not constitute departures from the spirit and scope of the invention.

We claim:

1. A method for removing liquid from a well bore and utilizing a tubing means having a gas inlet portion and a liquid discharge portion and a first valve connected to the liquid discharge portion, the tubing means having an opening therein comprising the steps of:

flowing liquid from said well bore into said tubing means through said opening;

flowing pressurized gas from the well bore into the gas inlet portion;

opening said first valve;

moving the liquid from said tubing means through the liquid discharge portion and out of the well.

2. A method as set forth in claim, 1 further including the step of:

sensing the amount of liquid in said tubing means prior to opening said first valve.

3. A method as set forth in claim 2 wherein a second valve is connected to the liquid discharge portion and to the well and further including the steps of:

opening said second valve and receiving pressurized gas in said liquid discharge portion;

closing said second valve when said first valve is opened.

4. A method as set forth in claim 1 further including the steps of:

sensing the passage of liquid through said liquid discharge portion;

closing said first valve and opening said valve in response to said sensing of the passage of liquid.

5. A method as set forth in claim 1 further including the step of filtering the liquid prior to its entering the tubing means through said opening.

6. A method as set forth in claim 4 further including a second valve connected to said liquid discharge line and to the bore hole and further including the steps of: closing said second valve while said first valve is open and opening said second valve upon the closing of said first valve.

7. A method as set forth in claim 1 further including the step of sensing well bore gas pressure and measuring the time interval from the initiation of the pumping cycle to the time for the liquid slug to reach the top of the well bore and in turn determining the quantity of liquid passing through the liquid discharge portion since the time interval will be proportional to the length of the liquid slug.

8. An apparatus for removing liquid from a well using well bore pressurized gas comprising;

tubing mean received in the well; said tubing means having a gas inlet portion and a liquid discharge portion; said gas inlet portion connected to said well for receiving well bore pressurized gas; said tubing means having a small opening therein for receiving liquid from the well; a first valve connected to said liquid discharge portion; means for opening and closing said first valve whereby when said first valve is closed liquid will accumulate in said tubing means and when said first valve is opened gas from said gas inlet portion will force the liquid through said liquid discharge portion and out of the well.

9. An apparatus as set forth in claim 8 further including a second valve connected to said liquid discharge portion of said tubing means and to said well for applying well bore pressurized gas to said liquid discharge portion when said second valve is opened; said second valve being closed when said first valve is open.

10. An apparatus as set forth in claim 8 wherein said opening in said tubing is located in the vicinity of the lowest portion of said tubing in the well.

11. An apparatus as set forth in claim 8 wherein said well is a gas producing well, and further includes a pipe connected to said well for gathering gas.

12. An apparatus as set forth in claim 8 wherein said tubing means includes a U-shaped tube having at least two lines; one of the lines being said gas inlet portion and the other of the lines being said liquid discharge portion.

13. An apparatus as set forth in claim 12 further including a connector line attaching said gas inlet portion to said gas liquid discharge portion; said opening being located in said connector line.

14. An apparatus as set forth in claim 8 wherein said tubing means includes an outer tube and an inner tube; said inner tube being received in said outer tube.

15. An apparatus as set forth in claim 7 wherein said inner tube is said liquid discharge portion and the outer tube is said gas inlet portion.

16. An apparatus as set forth in claim 8 further including a first sensing means for sensing a predetermined amount of liquid in said tubing means; means for initiating the opening of said first valve in response to said first sensing means.

17. An apparatus as set forth in claim 16 further including a second valve connected to said liquid discharge line and to bore hole, said means for initiating also closing said second valve.

18. An apparatus as set forth in claim 16 wherein said means for initiating is a controller.

19. An apparatus as set forth in claim 18 wherein said controller initiates closing of said first valve after a predetermined time.

20. An apparatus as set forth in claim 18 further including a second sensing means located near said first valve; said second sensing means electrically connected to said controller for closing said first valve upon sensing the liquid passing through said liquid discharge portion.

21. An apparatus as set forth in claim 20 wherein said second valve is opened at the time that said first valve is closed in response to said second sensing means.

22. An apparatus as set forth in claim 18 further including a battery connected to said controller for auto controller.

23. An apparatus as set forth in claim 1 further including a liquid sensing means located near said first valve; said first valve being closed after a predetermined time after a response from said sensing means.

24. An apparatus as set forth in claim 23 further including a second valve connected to said liquid discharge line and to said bore hole; a controller; said sensing means electrically connected to said controller for closing said first valve after sensing liquid passing through the liquid discharge portion; said controller subsequently causing said second valve to open; said controller being programmed to initiate the pumping cycle by closing said second valve and subsequently opening said first valve.

25. An apparatus as set forth in claim 23 further including a well bore gas pressure sensor connected to said controller.

* * * * *